US007992964B2

(12) United States Patent
Yanagisawa et al.

(10) Patent No.: US 7,992,964 B2
(45) Date of Patent: Aug. 9, 2011

(54) LIQUID-JET HEAD APPARATUS HAVING A FIXING PLATE FORMED WITH A PROTRUSION

(75) Inventors: Isao Yanagisawa, Nagano-ken (JP); Yasuo Inaoka, Nagano-ken (JP); Hiroshige Owaki, Nagano-ken (JP); Yoshihiro Igarashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1139 days.

(21) Appl. No.: 11/512,179

(22) Filed: Aug. 30, 2006

(65) Prior Publication Data

US 2007/0046727 A1 Mar. 1, 2007

(30) Foreign Application Priority Data

Aug. 31, 2005 (JP) ..... 2005-252093
Jul. 18, 2006 (JP) ..... 2006-195878

(51) Int. Cl.
*B41J 2/14* (2006.01)
*B41J 2/045* (2006.01)

(52) U.S. Cl. ..... 347/47; 347/71

(58) Field of Classification Search ..... 347/47, 347/45, 70, 71, 65
See application file for complete search history.

(56) References Cited

U.S. PATENT DOCUMENTS 6,176,571 B1 * 1/2001 Kishima et al. ..... 347/70
7,331,652 B2 * 2/2008 Hattori et al. ..... 347/47
2001/0050703 A1 * 12/2001 Ono et al. ..... 347/65
2002/0105567 A1 8/2002 Yamada et al.
2003/0030698 A1 * 2/2003 Ikegame et al. ..... 347/47
2005/0046668 A1 3/2005 Owaki
2005/0110835 A1 * 5/2005 Ito et al. ..... 347/47
2006/0061621 A1 * 3/2006 Seto ..... 347/45

FOREIGN PATENT DOCUMENTS

EP 0 615 844 A1 9/1994
JP 5-201000 A 8/1993
JP 10-016240 A 1/1998
JP 11-207979 A 8/1999
JP 2000-190513 A 7/2000
JP 2004-042298 A 2/2004
JP 2006-068981 A 3/2006
KR 10-2005-0021273 3/2005

OTHER PUBLICATIONS

"Standards for Burrs", Metalforming magazine online (web archive from Nov. 14, 2002), http://web.archive.org/web/20021114143343/http://archive.metalformingmagazine.com/1996/12/6mfdec5.htm.*

* cited by examiner

*Primary Examiner* — Stephen D Meier
*Assistant Examiner* — Carlos A Martinez, Jr.
(74) *Attorney, Agent, or Firm* — Sughrue Mion, PLLC

(57) ABSTRACT

A liquid-jet head, including: a plurality of head bodies each furnished with a nozzle plate having a plurality of nozzles formed therein; a joining member, adhered to the nozzle plate via an adhesive agent, for binding and fixing the plurality of head bodies; an opening formed in a region of the joining member corresponding to the nozzles; and a protrusion formed in an edge portion of the opening facing the nozzle plate, and protruding toward the nozzle plate, wherein when the joining member is joined to the nozzle plate via the adhesive agent, the protrusion is allowed to bite into the nozzle plate.

8 Claims, 9 Drawing Sheets

LIQUID-JET HEAD APPARATUS HAVING A FIXING PLATE FORMED WITH A PROTRUSION

The entire disclosure of Japanese Patent Applications Nos. 2005-252093 filed Aug. 31, 2005 and 2006-195878 filed Jul. 18, 2006 is expressly incorporated by reference herein.

BACKGROUND

1. Technical Field

The present invention relates to a liquid-jet head and a liquid-jet apparatus in which liquid droplets are ejected through a nozzle bored in a nozzle plate. More particularly, the invention relates to an ink-jet recording head and an ink-jet recording apparatus in which a part of a pressure generating chamber communicating with the nozzle is constructed from a vibration plate, and a piezoelectric element provided on the vibration plate is displaced to eject ink droplets through the nozzle.

The invention also relates to a method for producing a liquid-jet head in which liquid droplets are ejected through a nozzle bored in a nozzle plate. More particularly, the invention relates to a method for producing an ink-jet recording head in which a part of a pressure generating chamber communicating with the nozzle is constructed from a vibration plate, and a piezoelectric element provided on the vibration plate is displaced to eject ink droplets through the nozzle.

2. Related Art

A liquid-jet head for ejecting liquid droplets through a nozzle by imparting pressure to a liquid by a piezoelectric element or a heating element has been known, and its representative example is an ink-jet recording head for ejecting ink droplets. The ink-jet recording head, for example, has a structure in which a nozzle plate having nozzles for ejection of ink droplets is joined onto an ink chamber body having pressure converting elements for imparting pressure to ink, and a protective plate or a nozzle cover, which is a joining member, is joined onto the nozzle plate via an adhesive agent (see, for example, JP-A-5-201000 (FIG. 1, pages 3 to 4, etc.)).

With such an ink-jet recording head, metal components constituting the ink-jet recording head are charged by a recording medium such as recording paper, or static electricity from the outside, with the result that the pressure converting elements for imparting pressure to ink, or a driver IC or the like for driving the pressure imparting elements may be destroyed. Such a problem is apt to occur, particularly when the nozzle plate is formed from a metallic material. In the ink-jet recording head described in JP-A-5-201000, for example, the protective plate or the nozzle cover joined onto the nozzle plate via the adhesive agent is brought into contact with the nozzle plate at a contact portion different from the site of adhesion to establish conduction between the protective plate or the nozzle cover and a ground line, thereby suppressing charging of the nozzle plate.

With the ink-jet recording head of the earlier technology, moreover, the protective plate or the nozzle cover, which is the joining member, is joined onto the nozzle plate via the adhesive agent. If the adhesive agent oozes out or squeezes out, therefore, the adhesive agent may extend into the site of contact between the protective plate or the nozzle cover and the nozzle plate, causing insulation and making it impossible to suppress charging. The use of a film adhesive agent is conceivable to prevent oozing-out or squeezing-out, but control over the position of film adhesion is so difficult that the cost will increase. Oozing-out or squeezing-out may be prevented with the use of an adhesive agent having a spacer, such as beads, kneaded therein. However, quality control of the adhesive agent has to be exercised carefully to avoid dispersion or settlement of the spacer, rendering control difficult and resulting in cost increase.

If the nozzle plate is subjected to insulating, water repellent treatment, the applied ink repellent film needs to be partly removed for formation of a conductive portion, thereby increasing processing man-hours. Furthermore, the protective plate or the nozzle cover is conductive to the nozzle plate by contact. Thus, a clearance can be produced at the site of contact because of an environmental change, such as a temperature change. As a result, elimination of static electricity is not reliably carried out, thus rendering reliability dubious. Besides, an adhesion surface and a contact surface are required between the protective plate or the nozzle cover and the nozzle plate, posing the problem of upsizing the entire head.

Such problems are true of other liquid-jet heads for ejecting other liquids than ink, as well as the ink-jet recording head for ejecting ink.

SUMMARY

An advantage of some aspects of the invention is to provide a liquid-jet head and a liquid-jet apparatus which can reliably perform contact between a connection member and a nozzle plate, regardless of environmental changes, and can enhance reliability of static elimination (elimination of static electricity).

Another advantage of the invention is to provide a method for producing a liquid-jet head, which can produce a liquid-jet head capable of reliably performing contact between a connection member and a nozzle plate, regardless of environmental changes, and enhancing reliability of static elimination.

According to a first aspect of the invention, there is provided a liquid-jet head, comprising: a plurality of head bodies each furnished with a nozzle plate having a plurality of nozzles formed therein; a joining member, adhered to the nozzle plate via an adhesive agent, for binding and fixing the plurality of head bodies; an opening formed in a region of the joining member corresponding to the nozzles; and a protrusion formed in an edge portion of the opening facing the nozzle plate, and protruding toward the nozzle plate, wherein when the joining member is joined to the nozzle plate via the adhesive agent, the protrusion is allowed to bite into the nozzle plate.

According to this aspect, the protrusion bites into the nozzle plate, so that contact between the joining member and the nozzle plate can surely be made, and the reliability of static elimination can be enhanced regardless of environmental changes. Moreover, a space is ensured between the joining member and the nozzle plate by the protrusion, so that the squeezing-out or oozing-out of the adhesive agent can be suppressed. Furthermore, a film adhesive agent, or an adhesive agent having a spacer, such as beads, kneaded therein is not necessary, thus making it possible to simplify the operation and reduce the cost. Additionally, the surface of contact between the joining member and the nozzle plate is not required. Thus, the head body can be formed in accordance with the area of the nozzle plate, and the head can be downsized.

It is preferable that the protrusion be formed from a surplus wall portion during formation of the opening.

In this case, the protrusion can be formed by the operation for forming the opening by means of press working or the like.

It is also preferable that the protrusion be allowed to bite into the nozzle plate by pressing the edge portion of the opening under planar pressure.

In this case, the protrusion can be allowed to bite reliably into the nozzle plate over a wide range, and snagging of paper or the like on the side of the joining member can be prevented by the planar press portion.

It is also preferable that the nozzle plate and the joining member be formed from a conductive member.

In this case, static electricity can be eliminated easily.

It is also preferable that an insulating, liquid repellent film be formed on a surface of the nozzle plate where liquid droplets are ejected, and the amount of biting of the protrusion into the nozzle plate exceed the thickness of the liquid repellent film.

In this case, even when the liquid repellent film is formed, the protrusion penetrates the liquid repellent film, and bites into the nozzle plate, thus reliably enabling static elimination.

It is also preferable that the joining member be a cover head for covering the plurality of head bodies.

In this case, static elimination can be performed reliably with the use of the cover head.

It is also preferable that the joining member be a fixing plate for positioning the plurality of head bodies relative to each other.

In this case, static elimination can be performed reliably with the use of the fixing plate.

According to a second aspect of the invention, there is provided a liquid-jet head, comprising: a plurality of head bodies each furnished with a nozzle plate having a plurality of nozzles formed therein; a joining member, adhered to the nozzle plate via an adhesive agent, for binding and fixing the plurality of head bodies; an opening formed in a region of the joining member corresponding to the nozzles; and a protrusion formed in an edge portion of the opening facing the nozzle plate, and protruding toward the nozzle plate, wherein the nozzle plate and the joining member are formed from a conductive member, an insulating, liquid repellent film is formed on a surface of the nozzle plate where liquid droplets are ejected, a site of the nozzle plate opposing the protrusion is rendered a liquid repellent film unformed portion, and when the joining member is joined to the nozzle plate via the adhesive agent, the protrusion is brought into contact with the liquid repellent film unformed portion of the nozzle plate.

According to this aspect, the protrusion contacts the liquid repellent film unformed portion of the nozzle plate, so that contact between the joining member and the nozzle plate, accompanied by conduction, can be reliably made, and the reliability of static elimination can be enhanced regardless of environmental changes. Moreover, a space is ensured between the joining member and the nozzle plate by the protrusion, so that the squeezing-out or oozing-out of the adhesive agent can be suppressed. Furthermore, a film adhesive agent, or an adhesive agent having a spacer, such as beads, kneaded therein is not necessary, thus making it possible to simplify the operation and reduce the cost. In addition, the surface of contact between the joining member and the nozzle plate is not required. Thus, the head body can be formed in accordance with the area of the nozzle plate, and the head can be downsized.

It is preferable that the protrusion be formed from a surplus wall portion during formation of the opening.

In this case, the protrusion can be formed by the operation for forming the opening by means of press working or the like.

It is also preferable that the joining member be a cover head for covering the plurality of head bodies.

In this case, static elimination can be performed reliably with the use of the cover head.

It is also preferable that the joining member be a fixing plate for positioning the plurality of head bodies relative to each other.

In this case, static elimination can be reliably performed with the use of the fixing plate.

According to a third aspect of the invention, there is provided a liquid-jet apparatus including the above liquid-jet head.

According to this aspect, the liquid-jet apparatus including the liquid-jet head capable of reliable static elimination can be obtained.

According to a fourth aspect of the invention, there is provided a method for producing a liquid-jet head, comprising: providing a nozzle plate in a head body, the nozzle plate having a plurality of nozzles formed therein; forming an opening in a region of a joining member corresponding to the nozzles by press working, the joining member being arranged to position the head body, and also forming a surplus wall portion in an edge portion of the opening facing the nozzle plate by the press working; and allowing the surplus wall portion to bite into the nozzle plate by pressing under planar pressure, when adhering the joining member to the nozzle plate via an adhesive agent.

According to this aspect, there can be obtained the method for producing a liquid-jet head which can produce the liquid-jet head capable of enhancing the reliability of static elimination.

According to a fifth aspect of the invention, there is provided a method for producing a liquid-jet head, comprising: providing a nozzle plate in a head body, the nozzle plate having a plurality of nozzles formed therein; forming an opening in a region of a joining member corresponding to the nozzles by press working, the joining member being arranged to position the head body; pointing a surface of an edge portion of the opening, where a burr has been formed by the press working, toward the nozzle plate when adhering the joining member to the nozzle plate; and allowing the burr to bite into the nozzle plate by pressing under planar pressure via an adhesive agent.

According to this aspect, the method for producing a liquid-jet head can produce the liquid-jet head capable of enhancing the reliability of static elimination by an easy process.

According to a sixth aspect of the invention, there is provided a method for producing a liquid-jet head, comprising: providing a nozzle plate in a head body, the nozzle plate being made of a conductive member and having a plurality of nozzles formed therein; forming an opening in a region of a joining member corresponding to the nozzles by press working, the joining member being made of a conductive member and arranged to position the head body, and also forming a surplus wall portion in an edge portion of the opening facing the nozzle plate by the press working; forming an insulating, liquid repellent film on a surface of the nozzle plate where liquid droplets are ejected, and also rendering a site of the nozzle plate opposing the surplus wall portion a liquid repellent film unformed portion; and bringing the surplus wall portion into contact with the liquid repellent film unformed portion of the nozzle plate by pressing under planar pressure, when adhering the joining member to the nozzle plate via an adhesive agent.

According to this aspect, the method for producing a liquid-jet head can produce the liquid-jet head capable of enhancing the reliability of static elimination.

According to a seventh aspect of the invention, there is provided a method for producing a liquid-jet head, comprising: providing a nozzle plate in a head body, the nozzle plate being made of a conductive member and having a plurality of nozzles formed therein; forming an opening in a region of a joining member corresponding to the nozzles by press working, the joining member being made of a conductive member and arranged to position the head body; forming an insulating, liquid repellent film on a surface of the nozzle plate where liquid droplets are ejected, and also rendering a site of the nozzle plate opposing an edge portion of the opening a liquid repellent film unformed portion; pointing a surface of the edge portion of the opening, where a burr has been formed by the press working, toward the nozzle plate when adhering the joining member to the nozzle plate; and bringing the burr into contact with the liquid repellent film unformed portion of the nozzle plate by pressing under planar pressure via an adhesive agent.

According to this aspect, the method for producing a liquid-jet head can produce the liquid-jet head capable of enhancing the reliability of static elimination by an easy process.

The liquid-jet head and the liquid-jet apparatus of the invention can reliably perform contact between the connection member and the nozzle plate, regardless of environmental changes, etc., and can enhance reliability of static elimination.

The method for producing a liquid-jet head according to the invention can produce a liquid-jet head capable of reliably performing contact between the connection member and the nozzle plate, regardless of environmental changes, etc., and enhancing reliability of static elimination.

BRIEF DESCRIPTION OF THE DRAWINGS

The invention will be described with reference to the accompanying drawings, wherein like numbers reference like elements.

DESCRIPTION OF EXEMPLARY EMBODIMENTS

The present invention will now be described in detail based on the embodiments offered below.

Figure 1:
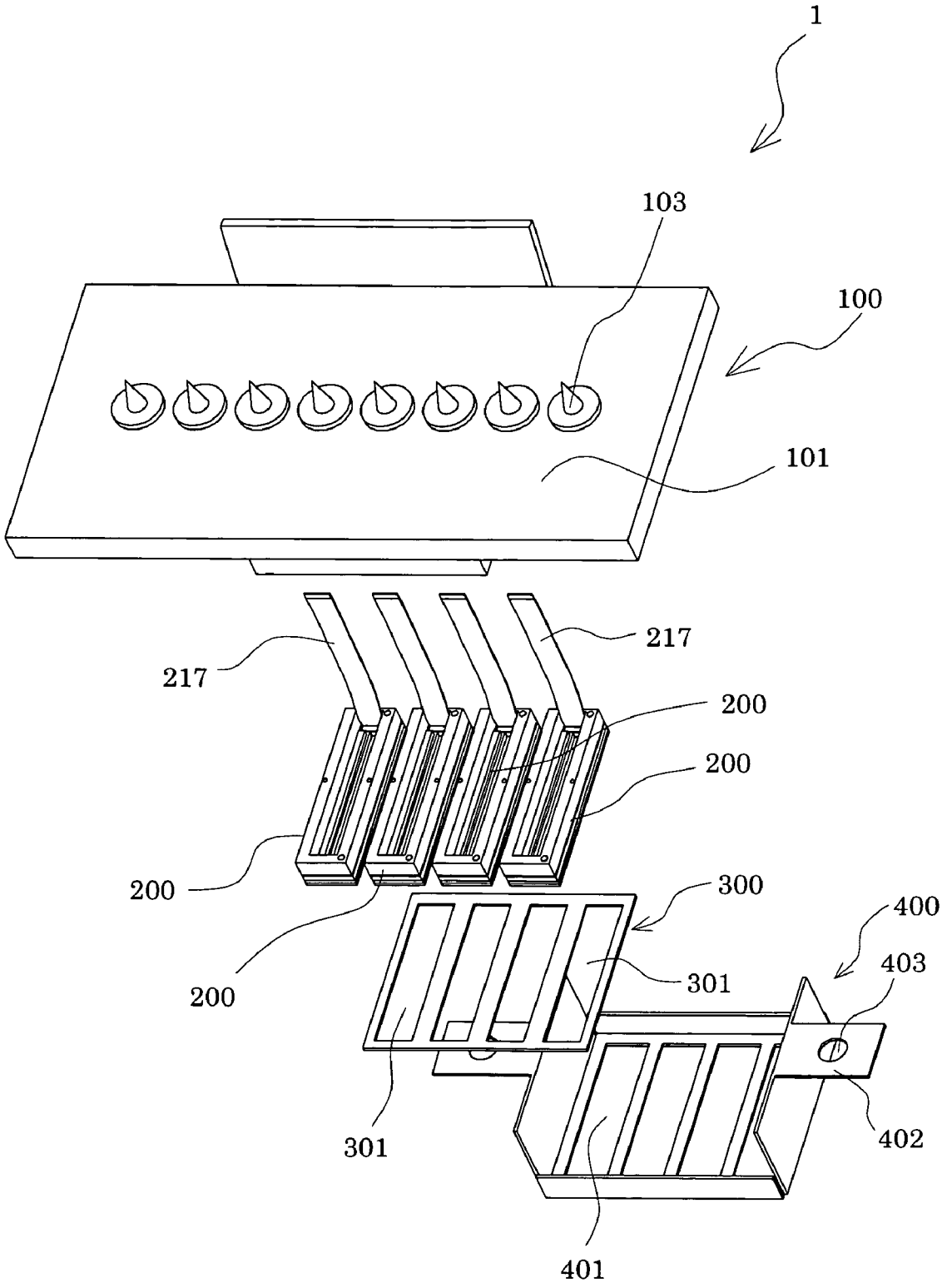
FIG. 1 is an exploded perspective view of an ink-jet recording head.
Figure 2:
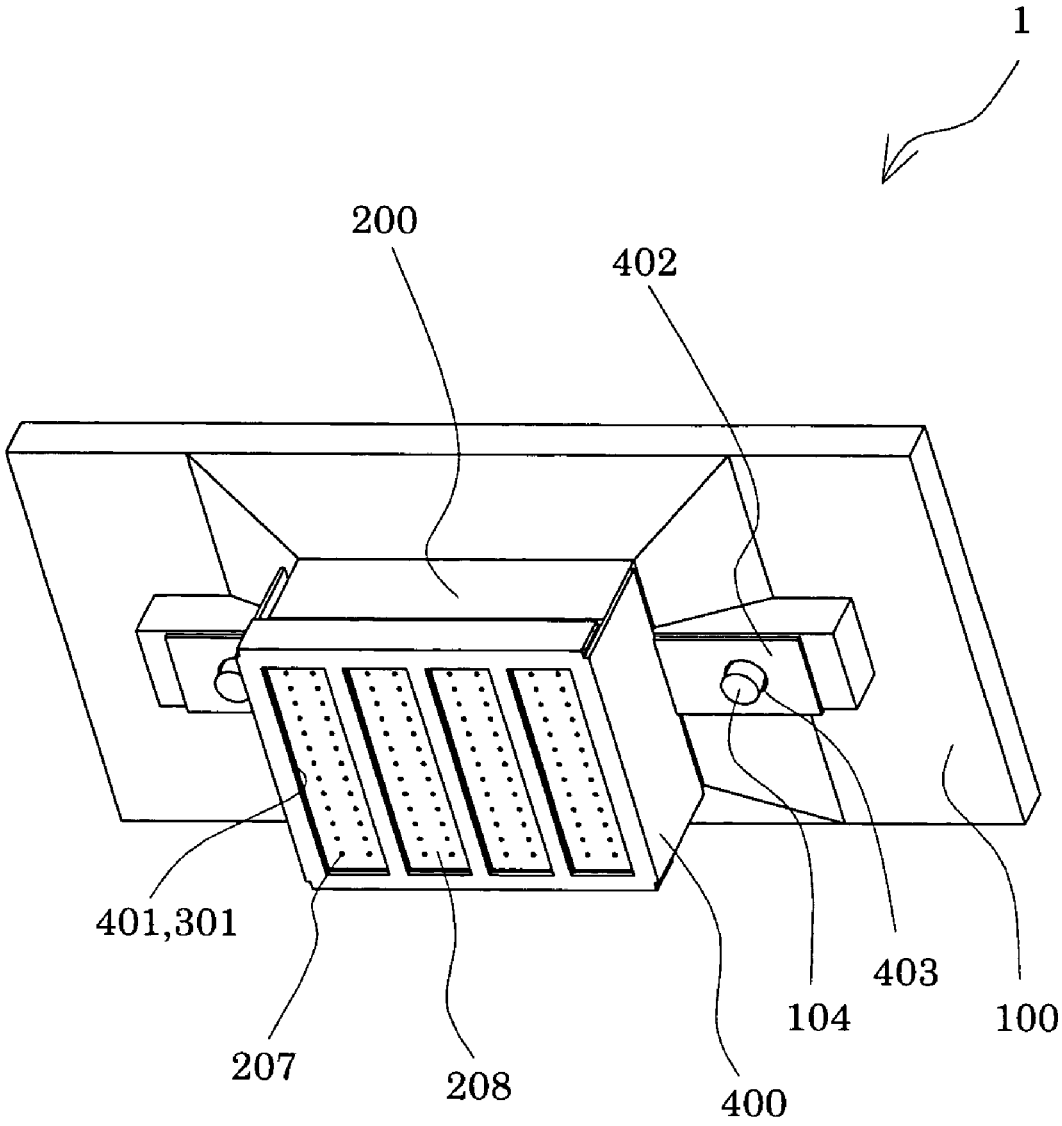
FIG. 2 is an assembled perspective view of the ink-jet recording head.
Figure 3:
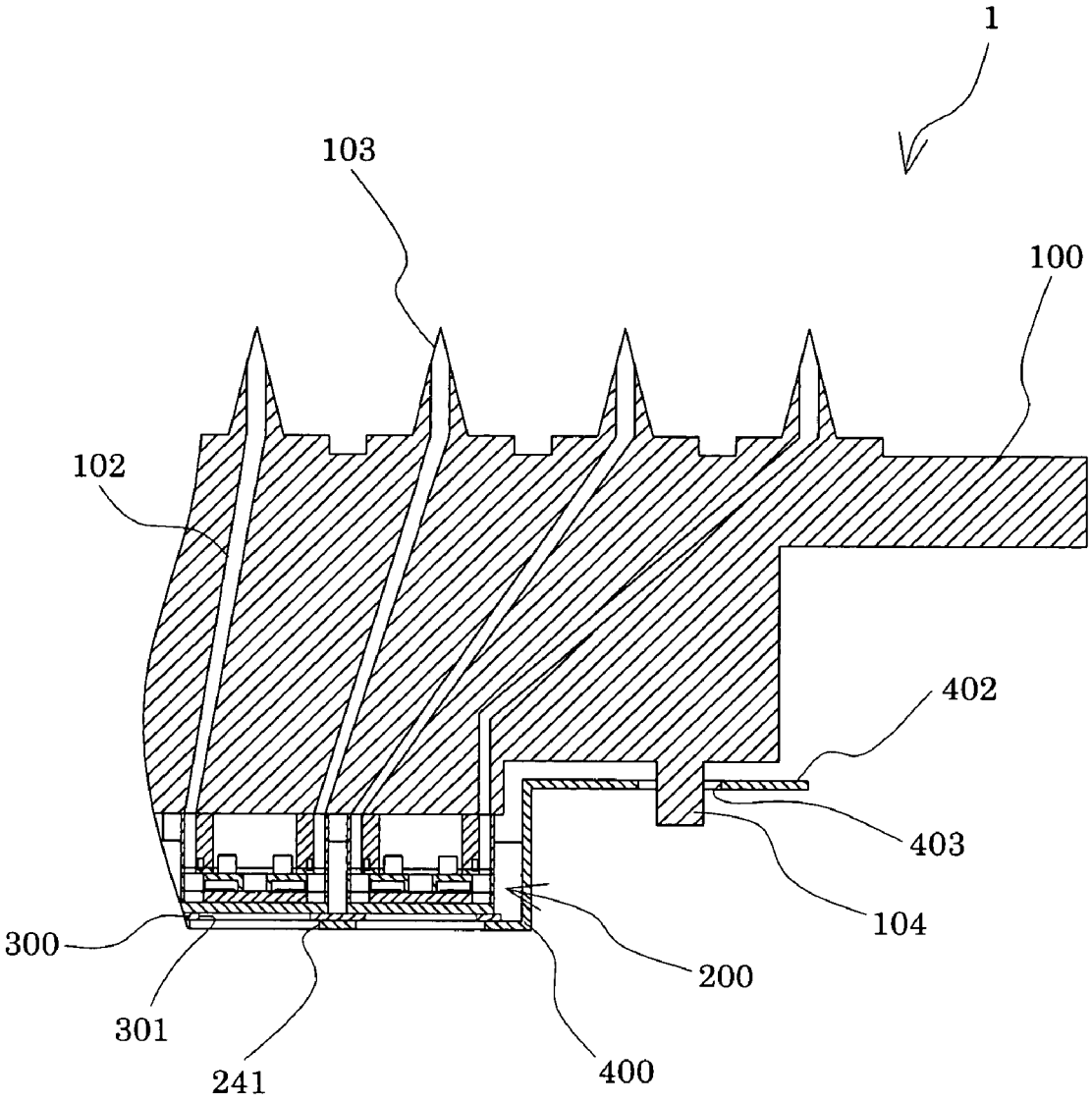
FIG. 3 is an essential sectional view of the ink-jet recording head.
Figure 4:
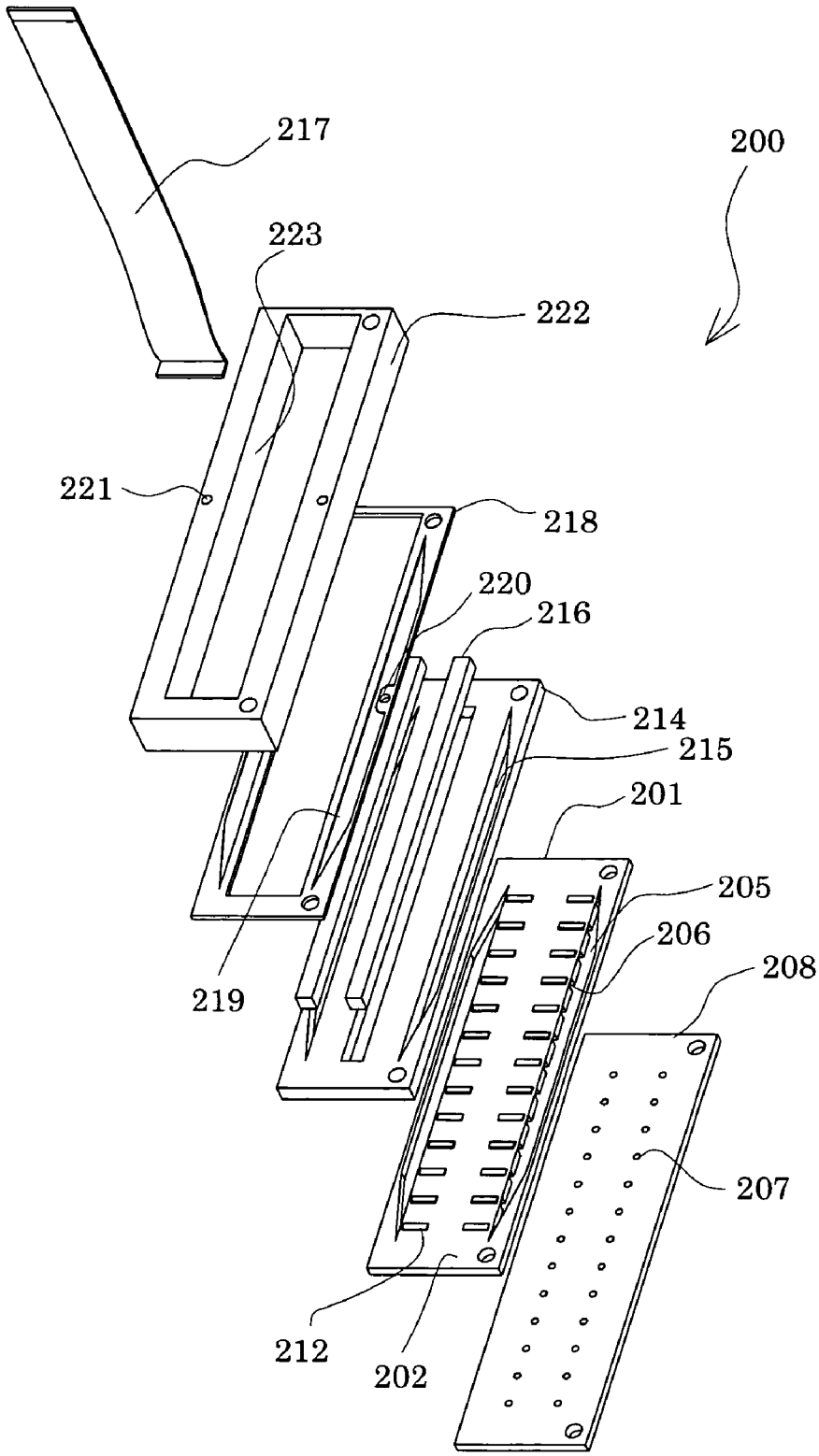
FIG. 4 is an exploded perspective view of an ink-jet recording head body.
Figure 5:
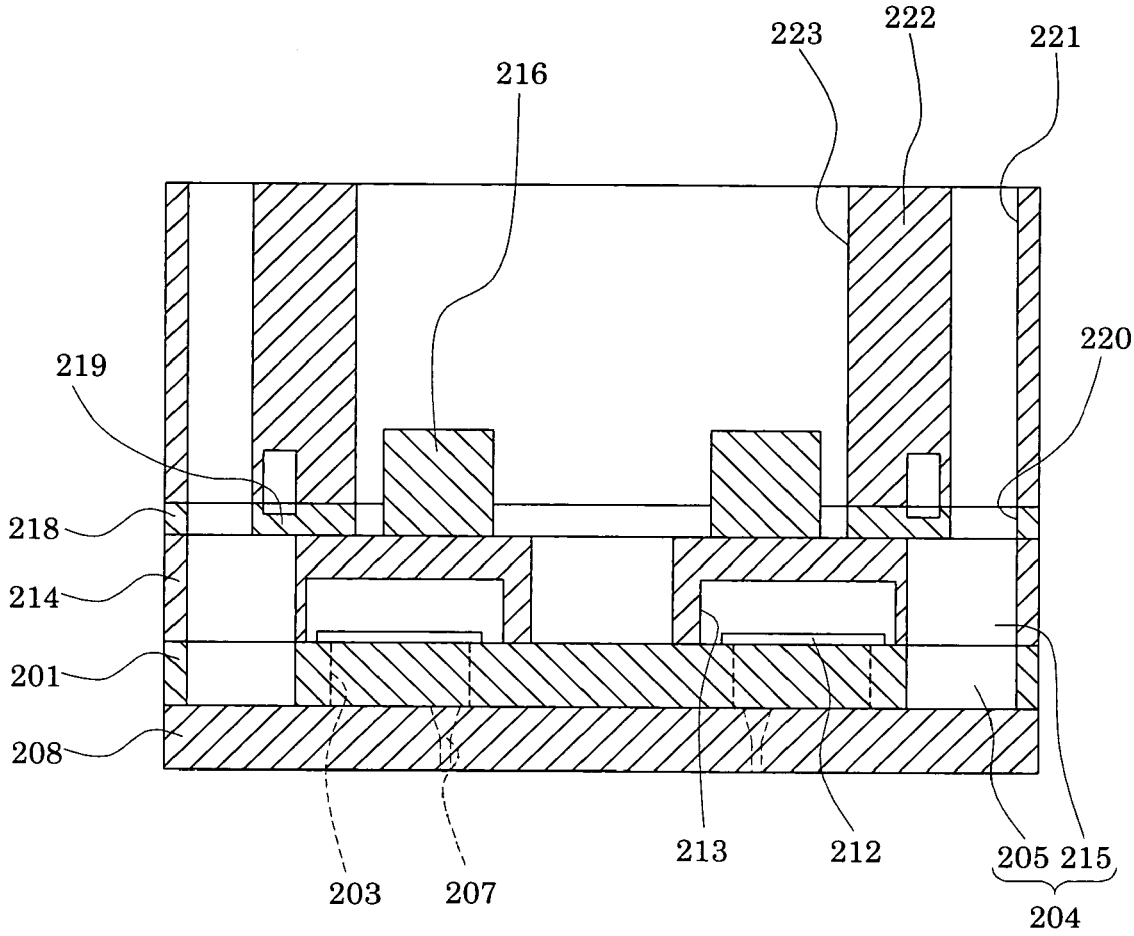
FIG. 5 is a sectional view of the recording head body.
Figure 6:
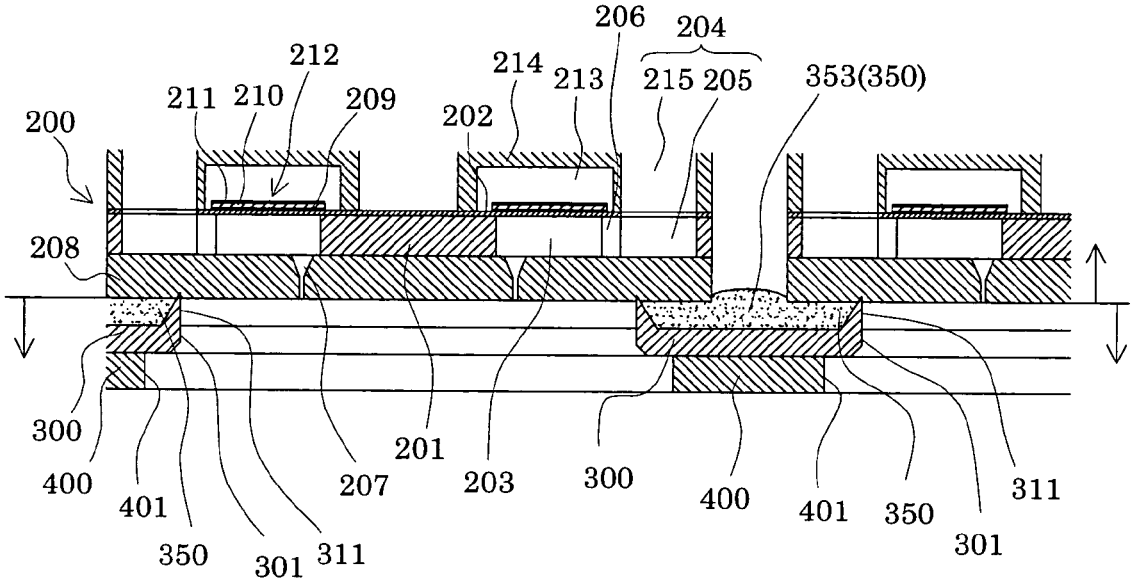
FIG. 6 is a sectional view showing essential parts of the recording head body.
Figure 7A:
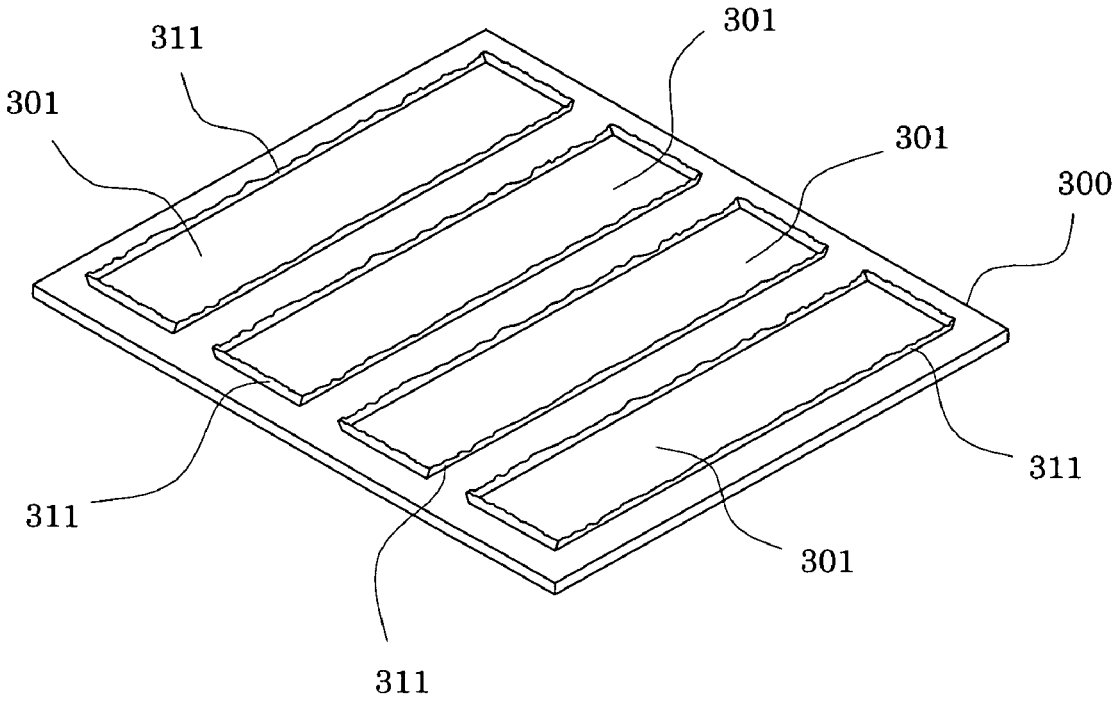
FIGS. 7A and 7B are perspective views of a fixing plate.
Figure 7B:
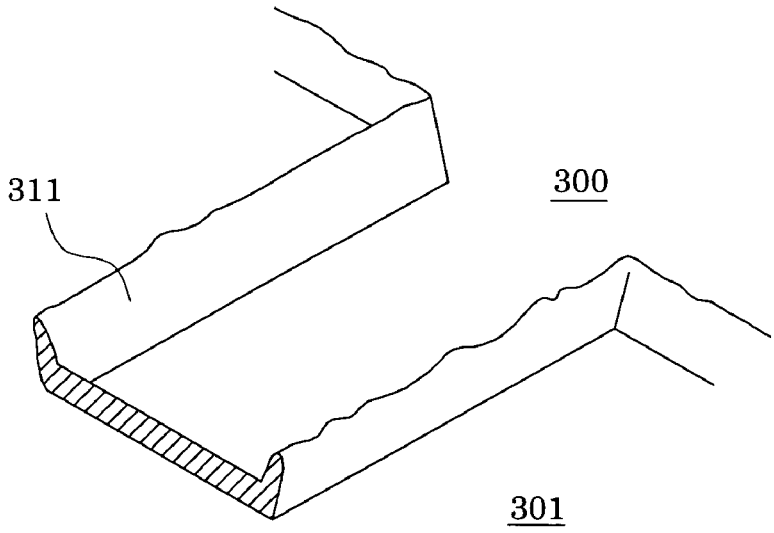
Figure 8A:
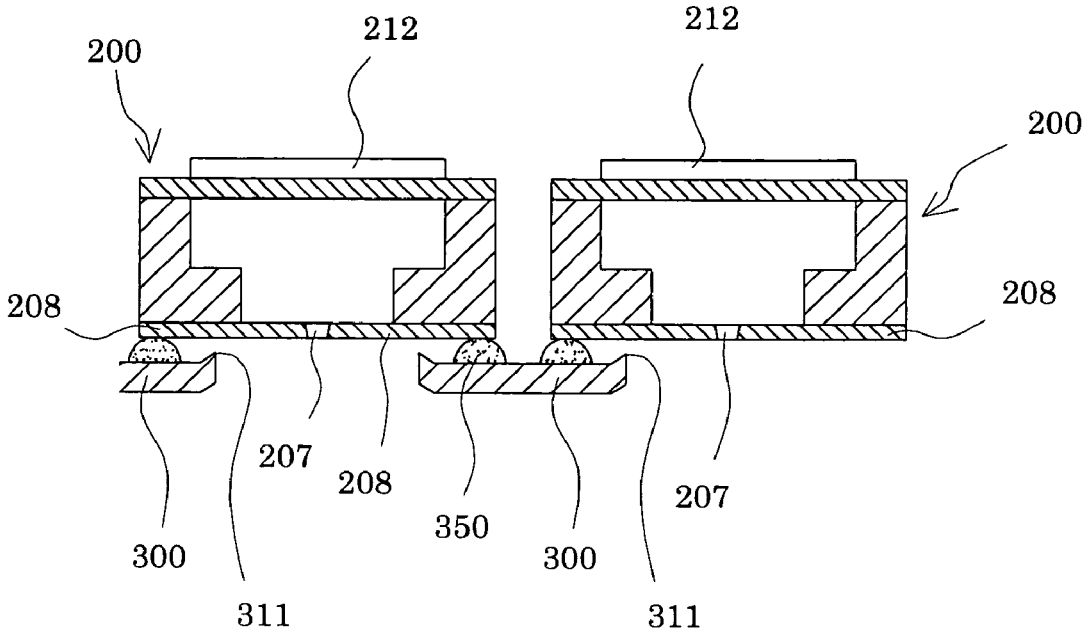
FIGS. 8A and 8B are essential flow charts of a method for producing the ink-jet recording head.
Figure 8B:
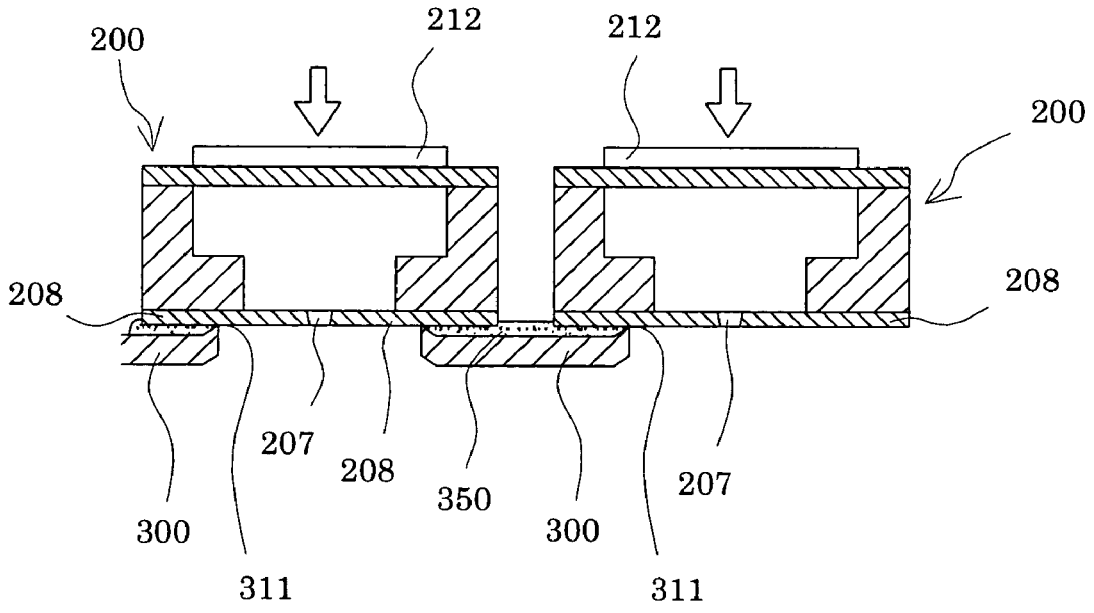
Figure 9:
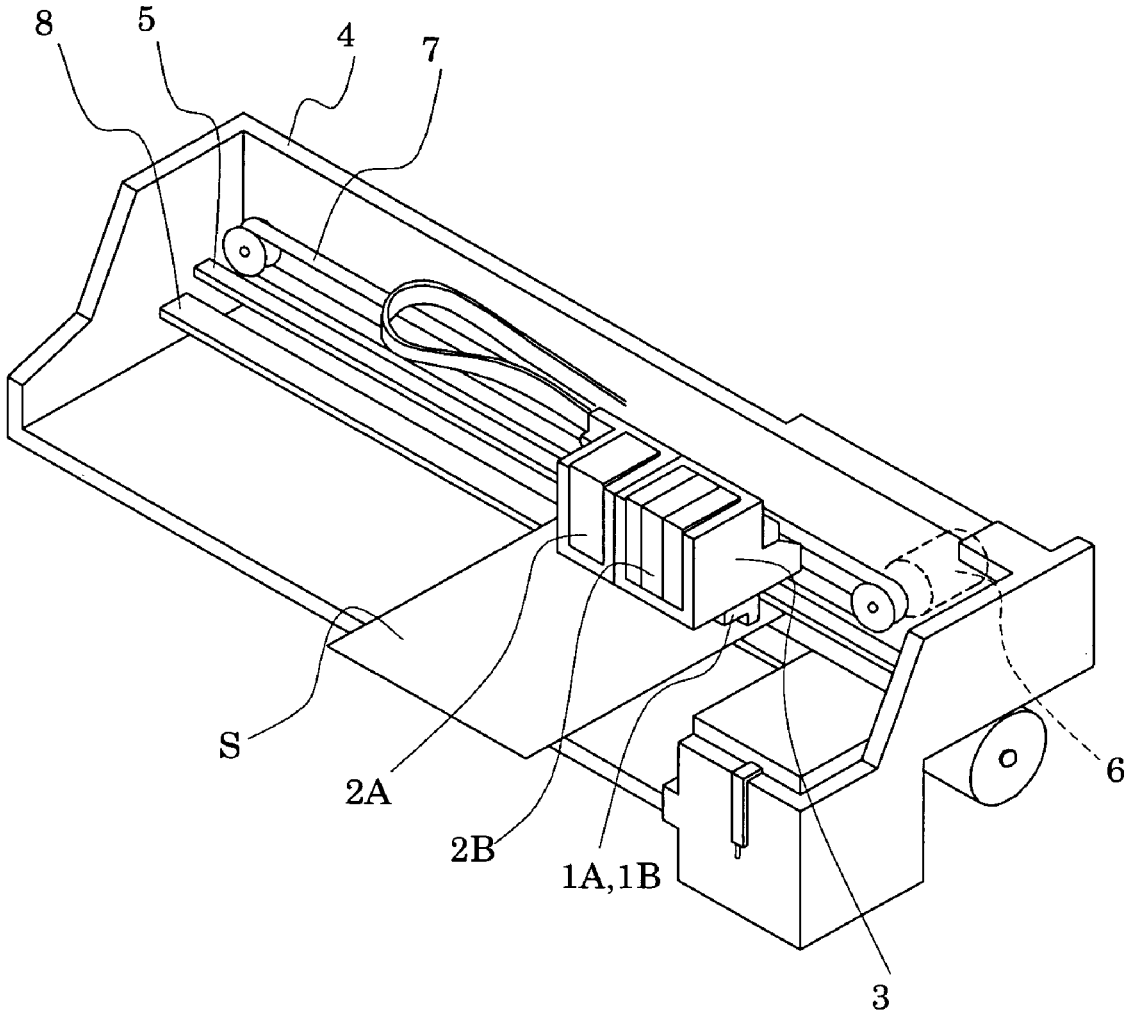
FIG. 9 is a schematic view of a recording apparatus.

FIG. 1 shows an exploded perspective state of an ink-jet recording head, as a liquid-jet head, according to an embodiment of the invention. FIG. 2 shows an assembled perspective state of the ink-jet recording head, as a liquid-jet head, according to the embodiment of the invention. FIG. 3 shows an essential sectional state of the ink-jet recording head, as a liquid-jet head, according to the embodiment of the invention. FIG. 4 shows an exploded perspective state of an ink-jet recording head body. FIG. 5 shows a sectional state of the recording head body. FIG. 6 shows a sectional state showing essential parts of the recording head body. FIGS. 7A and 7B show perspective states of a fixing plate. FIGS. 8A and 8B show the essential flow of a method for producing the ink-jet recording head which is a liquid-jet head. FIG. 9 shows a schematic state of a recording apparatus as a liquid-jet apparatus.

The configuration of an ink-jet recording head will be described with reference to FIGS. 1 to 7A, 7B.

An ink-jet recording head 1 (liquid-jet head; hereinafter referred to as the recording head) shown here has a cartridge case 100, an ink-jet recording head body 200 (hereinafter referred to as the recording head body), a fixing plate 300 as a joining portion, and a cover head 400. The cartridge case 100 has a cartridge mounting portion 101 to be mounted with ink cartridges (not shown) which are ink supply units. A plurality of ink communicating paths 102 each having an end open at the cartridge mounting portion 101 and the other end open toward the recording head body 200 are provided at the bottom surface of the cartridge case 100. Ink supply needles 103, which are inserted into the ink cartridges, are fixed at parts of the cartridge mounting portion 101 where the ink communicating paths 102 are open.

A plurality of (four in the illustrated embodiment) the recording head bodies 200 (a recording head unit), which are positioned with predetermined spacing, is fixed on the bottom surface of the cartridge case 100. The four recording head bodies 200 of the recording head unit are provided for different colors of inks, and the four recording head bodies 200 are adhered and fixed to the fixing plate 300 for positioning with respect to each other. The recording head unit is provided, in such a positioned state, on the bottom surface of the cartridge case 100.

The configuration of the recording head body 200 will be described with reference to FIGS. 4 and 5.

As shown in the drawings, a passage-forming substrate 201 constituting the recording head body 200 consists, for example, of a single crystal silicon substrate. An elastic film 202 formed beforehand by thermal oxidation and comprising silicon dioxide is formed on one surface of the passage-forming substrate 201. In the passage-forming substrate 201, a plurality of pressure generating chambers 203 is formed, and the pressure generating chambers 203 have been formed by anisotropic etching performed from the other surface of the passage-forming substrate 201. For example, the pressure generating chambers 203 are disposed parallel in the width direction of the passage-forming substrate 201 to form a row of the pressure generating chambers 203, and two of the rows are provided. A communicating portion 205 constituting a reservoir 204 is formed outwardly in the longitudinal direction of the pressure generating chambers 203 in each row. The communicating portion 205 communicates with a reservoir portion provided in a protective plate (to be described later), and the reservoir 204 serves as a common ink chamber for the respective pressure generating chambers 203. The communicating portion 205 is brought into communication with an end portion in the longitudinal direction of each pressure generating chamber 203 via an ink supply path 206.

Onto an opening surface of the passage-forming substrate 201, a nozzle plate 208 having nozzles 207 bored therein is secured by an adhesive agent or a heat sealing film. The nozzle plate 208 is formed, for example, from a conductive material such as a metallic material (e.g., stainless steel: SUS).

Piezoelectric elements 212 are formed on the elastic film 202 formed on the surface of the passage-forming substrate 201. The piezoelectric element 212 is composed of a lower electrode film (not shown) comprising a metallic material such as platinum or iridium, a piezoelectric layer (not shown) comprising, for example, lead zirconate titanate (PZT) and an upper electrode film (not shown) comprising a metallic material such as iridium.

A protective plate 214 having a piezoelectric element holding portion 213, which can ensure a space where the movement of the piezoelectric elements 212 is not impeded in a region opposite the piezoelectric elements 212, is joined onto the passage-forming substrate 201 having the piezoelectric elements 212 formed thereon. A reservoir portion 215, which communicates with the communicating portion 205 of the passage-forming substrate 201 to constitute the reservoir 204 serving as the common ink chamber for the respective pressure generating chambers 203, as described above, is formed in the protective plate 214.

Drive IC's 216 for driving the piezoelectric elements 212 are mounted on the protective plate 214. Each terminal of the drive IC 216 is connected via a bonding wire or the like to a lead electrode drawn from an individual electrode of each piezoelectric element 212, although this is not shown. An external wiring 217 such as a flexible printed cable (FPC), as shown in FIG. 1, is connected to each terminal of the drive IC 216, and various signals, such as print signals, are supplied via the external wiring 217.

A compliance plate 218 is joined onto the protective plate 214 in a region corresponding to the reservoir 204. A flexible portion 219 having a smaller thickness than in other regions is provided in a region of the compliance plate 218 corresponding to the reservoir 204. Changes in the pressure within the reservoir 204 are accommodated by the deformation of the flexible portion 219. Ink introducing ports 220 communicating with the reservoir 204 are formed in the compliance plate 218.

A head case 222, which has ink supply passages 221 communicating with the ink introducing ports 220 and also communicating with the ink communicating paths 102 of the cartridge case 100, is bonded onto the compliance plate 218. Ink is supplied into the reservoir 204 via the ink communicating paths 102, the ink supply passages 221, and the ink introducing ports 220. A drive IC holding portion 223, which penetrates the head case 222 in its thickness direction, is provided in a region of the head case 222 opposing the drive IC's 216. A potting agent is filled into the drive IC holding portion 223 so as to cover each drive IC 216, although this is not illustrated.

The interior of the recording head body 200, ranging from the reservoir 204 to the nozzles 207, is filled with ink. Then, voltage is applied to each piezoelectric element 212 corresponding to the pressure generating chamber 203 in accordance with recording signals from the drive IC 216 to cause deflective deformation of the elastic film 202 and the piezoelectric element 212. This imparts pressure to the ink within each pressure generating chamber 203, thereby ejecting ink droplets from the nozzle 207.

The four recording head bodies 200 are adhered and fixed to the fixing plate 300 in a state in which they are positioned with predetermined spacing relative to each other, as shown in FIG. 6. Since the fixing plate 300 consists of a flat plate free of large ribs, it is easy to assemble the four recording head bodies 200 thereto. In the fixing plate 300, exposure opening portions 301, as openings for exposing the nozzles 207, are provided in correspondence with the recording head bodies 200. The fixing plate 300 is joined via an adhesive agent 350 to a peripheral edge portion of the nozzle plate 208 constituting each recording head body 200.

A protrusion 311, which protrudes toward the nozzle plate 208, is formed in an edge portion of the exposure opening portion of the fixing plate 300. When the fixing plate 300 is joined to the nozzle plate 208 via the adhesive agent 350, the protrusion 311 bites into the nozzle plate 208. The protrusion 311 is formed in a size of the order of 3 μm, and the exposure opening portion 301 is pressed, under planar pressure, against the nozzle plate 208 during adhesion, whereby the protrusion 311 bites into the surface of the nozzle plate 208 where ink droplets are ejected. The fixing plate 300 contacts the nozzle plate 208 via the protrusion 311, and the fixing plate 300 is formed, for example, from a conductive material such as a metallic material (e.g., stainless steel: SUS), as is the nozzle plate 208.

The protrusion 311 measuring about 3 μm is caused to bite into the nozzle plate 208, whereby the tip of the protrusion 311 can be entered into the nozzle plate 208 by a dimension of the order of 1 μm. Thus, the resistance value can be limited to 10 Ω or less (2 Ω or less), and the elimination of static electricity can be performed satisfactorily.

The fixing plate 300 will be described in detail based on FIGS. 7A, 7B. FIG. 7A shows the appearance status of the fixing plate 300 after punching, and FIG. 7B shows the detailed status of the edge portion.

The exposure opening portion 301 of the fixing plate 300 is punched out by press working, and a surplus wall portion is formed as a burr after punching. The surplus wall portion formed during punching serves as the protrusion 311. The fixing plate 300 is pressed against the nozzle plate 208, with the surface of the protrusion 311 (the surface where the burr is formed) being pointed toward the nozzle plate 208. Thus, the surplus wall portion formed by press working can be applied as such, and there is no need for a special step for forming the protrusion 311. Moreover, control of the burr due to press working can be exercised easily, and the processing cost and the labor for processing can be decreased.

The formation of the exposure opening portion 301 is not limited to punching with a press, but other processing technology (laser cutting, mechanical cutting, etc.) can be used. In this case, the protrusion 311 is formed in a different step, but processing for forming the protrusion 311 can be carried out, so that the protrusion 311 can be formed with desired accuracy.

The adhesion status of the fixing plate 300 will be described in detail based on FIGS. 8A, 8B. FIG. 8A shows the status before adhesion, and FIG. 8B shows the status after adhesion.

As shown in FIG. 8A, the adhesive agent 350 is applied between the fixing plate 300 and the nozzle plate 208, and each recording head body 200 is registered with a predetermined position. Then, as shown in FIG. 8B, the fixing plate 300 is pressed against the nozzle plate 208 under pressure to crush the adhesive agent 350. At this time, the end portion of the exposure opening portion 301 of the fixing plate 300 is pressed, under planar pressure, against the nozzle plate 208, whereby the protrusion 311 is allowed to bite into the nozzle plate 208. Then, the adhesive agent 350 is set by a drying step to fix the fixing plate 300 and the nozzle plate 208 to each other.

Thus, a certain space can be ensured between the nozzle plate 208 and the fixing plate 300 by the protrusion 311, thus suppressing the squeezing-out of the adhesive agent 350, eventually preventing insulation. Moreover, the squeezing-out of the adhesive agent 350 can be suppressed without the use of a film adhesive agent or an adhesive agent having a spacer, such as beads, kneaded therein. Thus, the operation for adhesion can be simplified, and the cost can be reduced.

Furthermore, there is no need for providing the site of contact between the nozzle plate 208 and the fixing plate 300, apart from the adhesion portion. Thus, the recording head body 200 can be formed in agreement with the area of the nozzle plate 208, so that the downsizing of the recording head body 200 can be achieved.

In addition, the protrusion 311 may be formed even in a part of the edge portion of the exposure opening portion 301, if only conduction is to be obtained by allowing the protrusion 311 to bite into the nozzle plate 208. However, if the protrusion 311 is provided throughout the edge portion of the exposure opening portion 301, as shown in FIG. 7A, the protrusion 311 can act as a bank for stopping the outflow of the adhesive agent 350, thereby preventing the adhesive agent 350 from flowing out into the exposure opening portion 301.

According to the above configuration, the protrusion 311 bites into the nozzle plate 208, thereby electrically connecting the nozzle plate 208 and the fixing plate 300. Thus, the fixing plate 300 is grounded, whereby static elimination can be performed even if the nozzle plate 208 is charged, for example, by friction due to sheet transport. Hence, the piezoelectric elements 212, etc. can be reliably prevented from being damaged owing to charging of the nozzle plate 208, namely, because of static electricity accumulated in the nozzle plate 208.

Moreover, the protrusion 311 bites into the nozzle plate 208, thus bringing a state in which the fixing plate 300 is fixed to the nozzle plate 208, with an elastic force acting. As a result, no clearance is formed at the contact portion because of an environmental change such as a temperature change, and the contact state can be reliably retained. Thus, the reliability of static elimination can be markedly enhanced.

The nozzle plate 208 maybe provided, at its surface (the surface where liquid droplets are ejected), with an insulating ink repellent film. The thickness of the ink repellent film is generally of the order of 1 μm at the largest. On the other hand, the protrusion 311 has a height of the order of 3 μm which is greater than the thickness of the ink repellent film. By allowing the protrusion 311 to bite into the nozzle plate 208, therefore, the protrusion 311 penetrates the ink repellent film. Thus, even when the nozzle plate 208 is provided with the insulating ink repellent film, the protrusion 311 can reliably bite into the nozzle plate 208 to bring the fixing plate 300 and the nozzle plate 208 into contact. Consequently, even if the ink repellent film is formed, static elimination can be reliably carried out, without treatment such as removal of the ink repellent film.

In the present embodiment, the protrusion 311 of the fixing plate 300 bites into the nozzle plate 208 having the ink repellent film formed thereon, and the protrusion 311 penetrates the ink repellent film to establish conduction between the nozzle plate 208 and the fixing plate 300. As another embodiment of the invention, it is possible to expose the site of the nozzle plate 208 opposite the protrusion 311 (an ink repellent film unformed portion), and bring the protrusion 311 of the fixing plate 300 into contact with the site of the exposed SUS. In this manner, the nozzle plate 208 and the fixing plate 300 are brought into contact with each other, without the biting of the protrusion 311 into the nozzle plate 208. Thus, even if the height of the burr constituting the protrusion 311 is insufficient, the nozzle plate 208 and the fixing plate 300 can be reliably placed in conduction to carry out static elimination.

The cover head 400 is provided around the four recording head bodies 200 fixed to the fixing plate 300, and the cover head 400 protects the four recording head bodies 200 from ink, etc. The cover head 400 has opening portions 401 in correspondence with the exposure opening portions 301 of the fixing plate 300.

As shown in FIGS. 1 to 3, the cover head 400 has flange portions 402 in its end portion, and each flange portion 402 is provided with a through-hole 403. Projections 104 are provided on a surface of the cartridge case 100 facing the recording head bodies 200. The projections 104 are fitted into the through-holes 403 of the cover head 400, and the front end of each projection 104 is heated and caulked to fix the cover head 400 to the cartridge case 100.

The material for the cover head 400 is not limited and, for example, a conductive material such as a metallic material may be used as in the case of the nozzle plate 208. When a conductive material is used to form the cover head 400, the fixing plate 300 and the cover head 400 may be electrically connected, and the cover head 400 may be grounded. If such a configuration is adopted, the cover head 400 and the fixing plate 300 are desirably joined using an adhesive agent, as for the joining of the nozzle plate 208 and the fixing plate 300.

According to the above-described configuration, the protrusion 311 bites into the nozzle plate 208, thereby electrically connecting the nozzle plate 208 to the fixing plate 300. Thus, their contact can be reliably made, and can be maintained in the presence of an environmental change such as a temperature change. Thus, the reliability of static elimination can be improved.

Moreover, the provision of the protrusion 311 results in the formation of an appropriate space between the nozzle plate 208 and the fixing plate 300. Thus, the squeezing-out or oozing-out of the adhesive agent 350 can be suppressed, without complete crushing of the adhesive agent 350. Since a special adhesive agent is not necessary, the adhesion operation can be simplified, and cost reduction can be achieved. A contact surface for grounding is not necessary, and thus the head can be formed in conformity with the area of the nozzle plate 208, so that the recording head body 200 can be downsized.

Even if the insulating ink repellent film is formed on the nozzle plate 208, the fixing plate 300 can be brought into contact with the nozzle plate 208 by the protrusion 311. Thus, conduction between the nozzle plate 208 and the fixing plate 300 can be reliably ensured, regardless of the material for the ink repellent film. Furthermore, the protrusion 311 is allowed to bite into the nozzle plate 208, whereby the maintainability of positional retention of each recording head body 200 can be enhanced.

The burr formed during press working for the fixing plate 300 is used as the protrusion 311, and the fixing plate 300 is adhered to the nozzle plate 208, with the burred surface of the fixing plate 300 being pointed toward the nozzle plate 208. Thus, there is no need for taking a special measure for dealing with the burr. Moreover, when the protrusion 311 is pressed against the nozzle plate 208, planar pressurization is performed, so that a sheet can be prevented from being snagged on an end portion of the fixing plate 300 during sheet transport.

As the joining member, the cover head 400 may be applied without using the above fixing plate 300, a protrusion (burr formed by press working) may be provided in the opening portion 401 of the cover head 400, and the protrusion of the opening portion 401 may be allowed to bite into the nozzle plate 208. In this case, the cover heat 400 is used for positioning and protecting the recording head bodies 200 from ink or the like. By so doing, the distance between each nozzle 207 of the nozzle plate 208 and the recording medium can be shortened. Thus, the flying distance of ink droplets can be decreased to fly the ink droplets to the recording medium reliably, thus improving printing quality. Even in this case, the provision of the protrusion 311 over the entire region of the edge portion of the opening portion 401 enables the protrusion 311 to become a bank for stopping the outflow of the adhesive agent adhering the cover head 400 and the nozzle plate 208 to each other, preventing the adhesive agent from flowing out into the opening portion 401.

The protrusion of the opening portion 401 of the cover head 400 comprising the conductive material is caused to bite into the nozzle plate 208 having the ink repellent film formed thereon. As a result, the protrusion penetrates the ink repellent film to establish conduction between the nozzle plate 208 and the cover head 400. As in the case of the aforementioned fixing plate 300, however, it is possible to expose the site of the nozzle plate 208 opposite the protrusion of the opening portion 401 from the ink repellent film (the exposed site: an ink repellent film unformed portion), and bring the protrusion of the opening portion 401 into contact with the site of the exposed SUS. In this manner, the nozzle plate 208 and the cover head 400 can be brought into contact with each other, without the biting of the protrusion of the opening portion 401 into the nozzle plate 208. Thus, even if the height of the burr constituting the protrusion of the opening portion 401 is insufficient, the nozzle plate 208 and the cover head 400 can be reliably placed in conduction to carry out static elimination.

The foregoing recording head 1 is mounted on an ink-jet recording apparatus as a liquid-jet apparatus. The outline of the ink-jet recording apparatus will be offered with reference to FIG. 9.

As shown in the drawing, cartridges 2A and 2B constituting ink supply units are detachably provided in recording heads 1A and 1B having the recording head bodies, and the recording heads 1A and 1B are installed on a carriage 3. A carriage shaft 5 is mounted on an apparatus body 4, and the carriage 3 bearing the recording heads 1A, 1B is provided on the carriage shaft 5 to be movable in the axial direction. The drive force of a drive motor 6 is transmitted to the carriage 3 via a plurality of gears (not shown) and a timing belt 7, whereby the carriage 3 bearing the recording heads 1A and 1B is moved along the carriage shaft 5. The apparatus body 4 is provided with a platen 8 along the carriage shaft 5, and a recording sheet S as a recording medium, such as paper, which has been fed by a sheet feed roller or the like (not shown), is transported on the platen 8.

In the above-described embodiment, the ink-jet recording head for ejecting ink droplets is taken for illustration as an example of the liquid-jet head. However, the invention can be widely applied to liquid-jet heads in general. Examples of liquid-jet heads include recording heads for use in image recording devices such as printers, color material jet heads for use in the production of color filters such as liquid crystal displays, electrode material jet heads for use in the formation of electrodes for organic EL displays and FED (field emission displays), and bio-organic material jet heads for use in the production of biochips. It should be understood that such changes, substitutions and alterations can be made therein without departing from the spirit and scope of the invention as defined by the appended claims.

What is claimed is:

1. A liquid-jet head, comprising:

a plurality of head bodies each furnished with a nozzle plate having a plurality of nozzles formed therein;

a fixing plate adhered to the nozzle plates with predetermined spacing relative to each other, for binding and fixing the plurality of head bodies;

an opening formed in a region of the fixing plate corresponding to the nozzles; and a protrusion being formed, which ensures a certain space between the nozzle plate and the fixing plate, in an edge portion of the opening portion of the fixing plate, protruding toward the nozzle plate, and being in biting contact with the nozzle plate.

2. The liquid jet head according to claim 1, wherein an insulating, liquid repellent film is formed on a surface of the nozzle plate where liquid droplets are ejected, and wherein the protrusion has a height which is greater than the thickness of the insulating, liquid repellent film.

3. The liquid-jet head according to claim 1, wherein the nozzle plate and the fixing plate are formed from a conductive member.

4. The liquid-jet head according to claim 3, wherein an insulating, liquid repellent film is formed on a surface of the nozzle plate where liquid droplets are ejected.

5. The liquid jet head according to claim 1, wherein the fixing plate is a cover head for covering the plurality of head bodies.

6. A liquid jet apparatus including the liquid-jet head according to claim 1.

7. A liquid-jet head, comprising:

a plurality of head bodies each furnished with a nozzle plate having a plurality of nozzles formed therein;

a fixing plate, adhered to the nozzle plates with predetermined spacing relative to each other, for binding and fixing the plurality of head bodies;

an opening formed in a region of the fixing plate corresponding to the nozzles; and a protrusion being formed, which ensures a certain space between the nozzle plate and the fixing plate, in an edge portion of the opening portion of the fixing plate, protruding toward the nozzle plate, wherein the nozzle plate and the fixing plate are formed from a conductive member, an insulating, liquid repellent film is formed on a surface of the nozzle plate where liquid droplets are ejected, a site of the nozzle plate opposing the protrusion is a liquid repellent film unformed portion, and wherein the protrusion is in contact with the nozzle plate at the liquid repellent film unformed portion of the nozzle plate.

8. The liquid-jet head according to claim 7, wherein the fixing plate is a cover head for covering the plurality of head bodies.

* * * * *